US006513210B1

(12) United States Patent
Gonzalez

(10) Patent No.: US 6,513,210 B1
(45) Date of Patent: Feb. 4, 2003

(54) DRAW-TIGHT ELASTIC CORDAGE

(75) Inventor: Miguel A. Gonzalez, Denver, CO (US)

(73) Assignee: Quest Technologies, Inc., Denver, CO (US)

( * ) Notice: Subject to any disclaimer, the term of this patent is extended or adjusted under 35 U.S.C. 154(b) by 0 days.

(21) Appl. No.: 09/831,222

(22) PCT Filed: Feb. 9, 2000

(86) PCT No.: PCT/US00/03369

§ 371 (c)(1),
(2), (4) Date: May 8, 2001

(87) PCT Pub. No.: WO00/61844

PCT Pub. Date: Oct. 19, 2000

Related U.S. Application Data

(60) Provisional application No. 60/129,776, filed on Apr. 14, 1999.

(51) Int. Cl.[7] ..... A44B 21/00; A43C 1/02; A43C 9/00

(52) U.S. Cl. ..... 24/712; 24/300; 24/712.7; 24/713.6; 24/715.3

(58) Field of Search ..... 24/712, 712.7, 24/713.6, 713.8, 715.3, 300; 36/50.1

(56) References Cited

U.S. PATENT DOCUMENTS

| | | | | | |
|---|---|---|---|---|---|
| 4,423,539 | A | * | 1/1984 | Ivanhoe | 24/712 |
| 4,694,541 | A | * | 9/1987 | Skyba | 24/300 |
| 4,865,015 | A | * | 9/1989 | Hasty et al. | 428/74 |
| 4,993,128 | A | * | 2/1991 | Gold | 24/715.3 |
| 5,023,982 | A | * | 6/1991 | Mehan | 24/715.3 |
| 5,467,507 | A | * | 11/1995 | Marsh et al. | 24/300 |
| 5,774,945 | A | * | 7/1998 | Ginocchio | 24/300 |
| 5,922,437 | A | * | 7/1999 | Bryant | 428/102 |
| 6,014,794 | A | * | 1/2000 | Mc Coy | 24/300 |

FOREIGN PATENT DOCUMENTS

JP 0116455 * 10/1979

* cited by examiner

*Primary Examiner*—Victor Sakran
(74) *Attorney, Agent, or Firm*—Richard E. Backus

(57) ABSTRACT

A cordage for threading through an opening. An elastic cord is provided with an elongated shank component and at least one outwardly expandable component. When the cord is under tension, the expandable component shrinks to a diameter which is sufficient to enable its movement through an opening, such as an eyelet of a shoe. In response to the tension being released, the expandable component enlarges to a diameter which is sufficiently large to resist movement through the opening.

10 Claims, 2 Drawing Sheets

DRAW-TIGHT ELASTIC CORDAGE

This is a continuation-in-part of provisional patent application Ser. No. 60/129,776 filed Apr. 14, 1999.

BACKGROUND OF THE INVENTION

1. Field of the Invention

This invention relates in general to elastic cordage for fastening or holding things in place. In particular, the invention relates to elastic cordage for threading through an opening, such as an eyelet, for use in fastening or holding various objects such as clothing items, including shoes, hats, shirts, pants, coats, belts, watchbands and the like, packaging such as bags, back packs, satchels and the like and various other items which are conventionally held or fastened by rope, string, thread, cloth, bungee cords and the like.

2. Description of the Related Art

The conventional means for fastening objects such a shoe is by pulling a shoelace through eyelets with the lace then tightened and tied into a knot. Other devices include mechanical closures such as latches, hooks or clamps for holding cords, ropes, string and the like in a manner which enables adjustment by releasing the latch to pull the cord, rope or string through to a new position.

Conventional shoestrings and mechanical fasteners have a number of limitations and drawbacks. Knots tied in shoestrings can become loose so that the shoe or other object unintentionally becomes unfastened. Mechanical closures devices are relatively expensive, and in many designs they are cumbersome to fasten, unfasten or adjust.

The need has been recognized for a draw-tight elastic cord which obviates the foregoing and other limitations and disadvantages of prior art fastener devices of the type described. Despite the various fastener devices in the prior art, there has heretofore not been provided a suitable and attractive solution to these problems.

OBJECTS AND SUMMARY OF THE INVENTION

It is a general object of the present invention to provide elastic cordage that can be used to fasten, tie or adjust an object while requiring no knot or mechanical device to prevent unfastening or slippage in the cording.

The invention provides a draw-tight elastic cordage adapted for threading through an opening. The cordage has one or more components along its length which are enlarged or bulged out in diameter when axial stress is reduced, and which when axial stress is increased are reduced in diameter. In one embodiment, the cordage comprises a length of integral elastic cord which is bulged out at axially spaced positions. Other embodiments provide an elastic core about which a flexible sheath is fitted. When the cordage is elongated under tension, the outer diameter of each bulged-out component is sufficiently small to enable threading through the opening. When the tension is released, portions of the sheath expand outwardly at axially spaced-apart locations. The outwardly expanded portions have diameters which are sufficiently large to resist movement of the cordage in one direction through the opening.

The foregoing and additional objects and features of the invention will appear from the following description of the invention taken in conjunction with the accompanying drawings.

DESCRIPTION OF THE PREFERRED EMBODIMENTS

Figure 1:
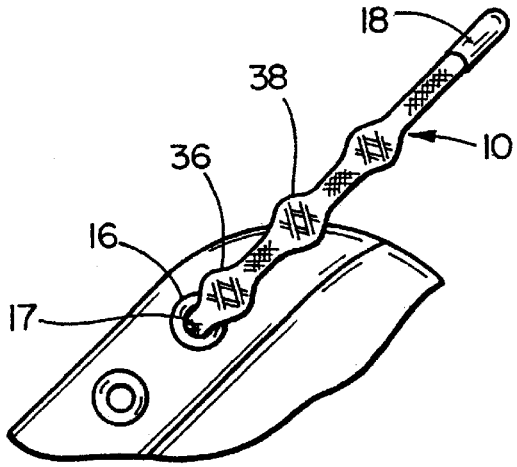
FIG. 1 is a perspective view illustrating elastic cordage in accordance with one embodiment of the invention showing in use through an opening formed by an eyelet.

FIGS. 1–4 illustrate generally at 10 a draw-tight elastic cordage in accordance with one preferred embodiment of the invention. Cordage 10 is comprised of an elongate elastic core 12 about which a flexible sheath 14 is fitted. In the illustrated embodiment where the cordage is for use with the eyelets 16 having an opening 17 in an article of clothing, such as a shoe, the core can be formed with a solid cylindrical shape, as shown in the cross section of FIG. 3. As desired, other shapes could be employed for the cordage. Thus the core could be tubular, or it could be a flat band in which the core has an oval or rectangular shape in cross section. Shoestring tips 18, which can be of conventional plastic or metal design, can be attached to opposite ends of the cordage.

Sheath 14 is formed with a plurality of end-to-end segments 20, 22. Each segment has a mid-portion 28, 28' and a pair of end portions 30, 32 which straddle the mid-portion. As shown in FIG. 2 adjacent segments share end portions. For example, end portion 30 is shared by segment 20 and the adjacent segment 22 of which mid-portion 28' is shown. The end portions are anchored with the core, while the mid-portions are detached from the core to enable outward flexible bulging or expansion into torus-shaped enlargements 36, 38 as shown in FIGS. 1 and 4.

Core 12 is formed of an elastic material, for example rubber or a suitable synthetic polymer, which elongates when stressed under tension, such as by the user pulling on an end or ends of the cordage. An example is a core formed of rubber. In the embodiment of FIGS. 1–4, flexible sheath 14 is formed of a braided matrix comprising threads of a suitable material such as cotton, polyester, nylon, acrylic or an elastic such as Spandex®.

Cordage 10 of the embodiment of FIGS. 1–4 can be manufactured by a process which includes first stretching core 12 so that the applied stress is below the material's critical stress. This ensures that non-recoverable plastic deformation does not occur. The stretching causes a portion of the core to elongate to a length $L_2$, as shown in FIG. 2. Also in the stressed condition the core has an outer diameter $D_2$. A braiding machine, which can be of conventional design, is then employed to weave or braid threads or strands about the core. The machine is operated to create alternating first and second braid patterns along the core's length. First braid patterns 40 and 42, for the respective end portions 30, 32, are formed with a braid which is sufficiently tight to frictionally grip or anchor with the core when the core is relaxed. Second patterns 44 and 46, for the respective mid-portions 28, 28', are formed with a braid which is sufficiently loose to enable the sheath to be detached from the core. These braid patterns cause the segments 20–26 extending along the cordage to alternate between end portions anchored to the core and mid-portions which are detached from it.

Figure 2:
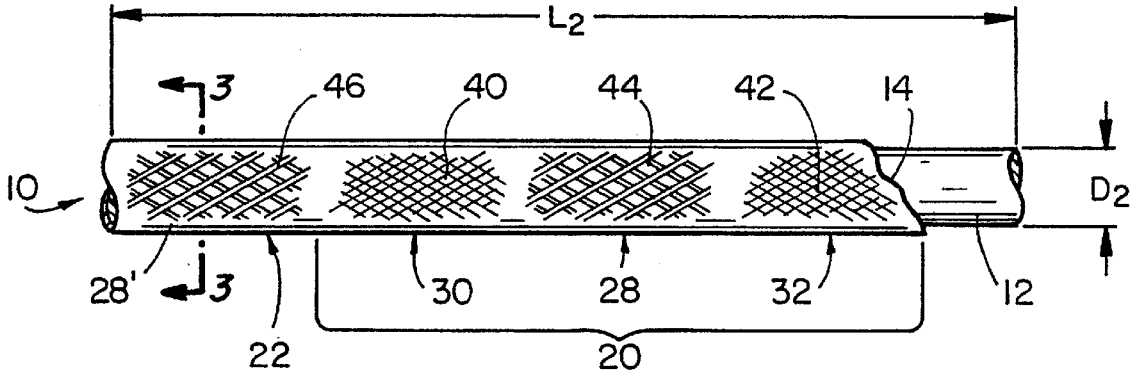
FIG. 2 is a side elevational view, partially broken away, showing portions of the cordage of FIG. 1 stressed under tension.
Figure 4:
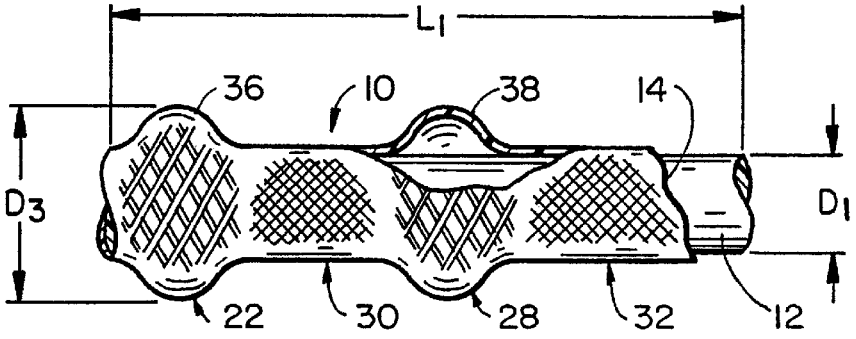
FIG. 4 is a side elevational view similar to FIG. 2 showing the cordage in an unstressed state with the tension relieved.
Figure 3:
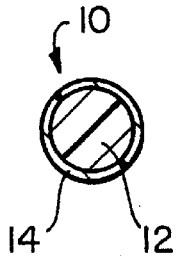
FIG. 3 is a cross sectional view taken along the line 3—3 of FIG. 2.

After the braiding operation is completed the tensile stress is removed to enable the cordage to assume its relaxed state as shown in FIGS. 1 and 4. In this state the core segment length contracts to $L_1$ while the core's outer diameter expands to $D_1$. In each segment, contraction of the core causes the sheath end portions to move toward each other which in turn pushes against the mid-portion to cause it to bunch up and expand or flex outwardly to the diameter $D_3$. Appropriate selection of the core and sheath material type, size and proportions results in $D_3$ being sufficiently large relative to the inner diameter of eyelet opening 17 so that the bunched up mid-portions resist threading movement of the cord in one direction through the opening. Thus as shown in FIG. 1 the bunched up mid-portion forming enlargement 36 is larger than the inner diameter of opening 17 to resist inward movement of the cordage through the eyelet. Where there is another similarly bunched up mid-portion (not shown) on the other side of the eyelet in FIG. 1, then it would prevent the cordage from being drawn through in an opposite direction. As used herein, "resist" means the case of where the enlarged mid-portion is blocked from movement under normal use, but which may allow the mid-portion to be squeezed down and pass through the opening when there is an abnormal force from the eyelet pressing against the enlarged mid-portion. This ties down or otherwise secures the portion of the shoe upper or clothing, pack or other device, as long as the cordage is in a relaxed or unstressed state.

When it is desired to release the cordage, the user simply pulls on one or both ends of the cordage to apply sufficient tension so that core elongates toward its length $L_2>L_1$ while the core contracts toward a diameter $D_2<D_1$. Elongation of the core in each segment pulls the sheath end portions apart. This in turn stretches the mid-portion which contracts from diameter $D_3$ to a size which is smaller than opening 17. The cordage can then be threaded through the opening to either release or readjust the article or device being fastened or tied down.

An example in accordance with the invention for use as a shoestring is cordage which, in an unstressed state, has the required length for threading through each of the eyelets of the shoe upper, for example 650 mm for an adult sized shoe with six eyelets on each side of the upper. In its unstressed state, core diameter $D_1$=4 mm, and the bunched up enlargement 38 has an outer diameter $D_3$=8 mm. One end of the cordage which is threaded through an upper eyelet on one side can, as an example, have a length $L_1$=100 mm. A pulling tensile stress applied to this end causes the core to elongate to a length $L_2$=200 mm and contract to a diameter $D_2$=3 mm. Each of the mid-portions in this end of the cordage contract back to a size fitting closely about the elongated core and which is sufficient to allow the cordage to then be threaded through the eyelet.

Figure 5:
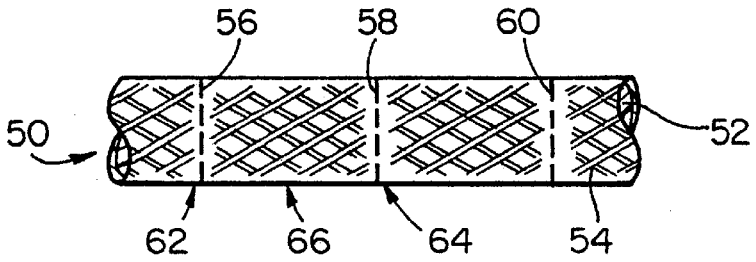
FIG. 5 is a fragmentary side elevational view of cordage in accordance with another embodiment.

FIG. 5 illustrates another embodiment providing cordage 50 which is comprised of a length of elastic core 52 made similar to that described for the embodiment of FIGS. 1–4. A sheath 54 of braided material, similar to that described for the embodiment of FIGS. 1–4, is fitted about the core with the same braid pattern along its length. A plurality of segments are formed by lines of stitching 56, 58, 60, when the core is under tensile stress, that penetrate through the sheath into the core at axially spaced-apart positions. Adjacent lines of the stitching form a pair of end portions 62, 64 which straddle a mid-portion 66. The end and mid-portions function in a manner similar to that described for the embodiment of FIGS. 1–4. When the tensile stress is released the core contracts so that end portions in each segment move together thereby causing the mid-portion to be pushed into an expanded shape which is sufficiently large to resist threading of the cordage through an appropriately sized eyelet or other opening.

Figure 6:
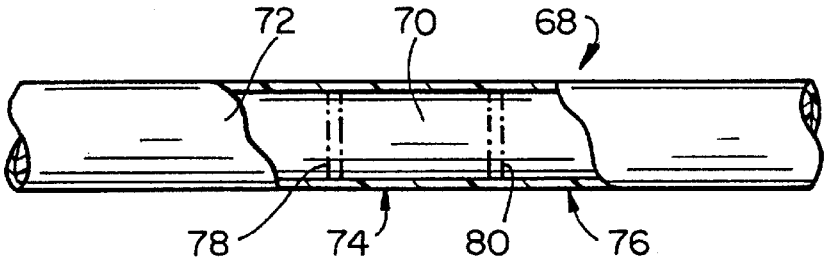
FIG. 6 is a fragmentary side elevational view partially broken away showing cordage in accordance with a further embodiment.

FIG. 6 illustrates another embodiment comprising cordage 68 with an elongated elastic core 70 of a similar composition to that described for the embodiment of FIGS. 1–4. A tubular sheath 72 is fitted about the outer surface of the core, and the sheath is formed of a suitable flexible compliant material such as a natural polymer, for example rubber, or a synthetic polymer such as a thermosetting elastomeric material. The core and tubular sheath can be separately formed. The core is then inserted through and sleeved within the sheath. Segments 74, 76 are formed along the cordage by anchoring a series of axially spaced end portions 78, 80 of the sheath to the core by suitable means such as sonic bonding, heat fusion, staples or rivets. the end portions could also be formed by annular bands, which could be elastic, about the sheath which press the end portions firmly against and frictionally engage with the core. The end portions could also be anchored by means of a suitable adhesive applied in annular coatings between the sheath and core.

Cordage 68 could also be formed by a co-extrusion process in which the sheath and core are extruded simultaneously in a manner which leaves the sheath detached from the core. End portions of the segments could then be formed by suitable means including sonic bonding, heat fusion and the like as described above.

Figure 7:
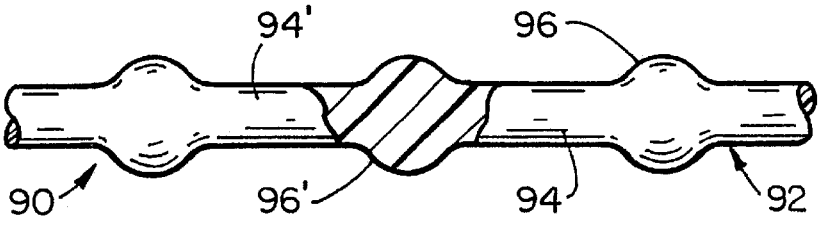
FIG. 7 is a fragmentary side elevation view partially broken away showing cordage in accordance with a further embodiment.

FIG. 7 illustrates another embodiment providing cordage 90 comprising a cord 92 which is formed by an extrusion process from a suitable elastic extrudable material, such as an elastic resin, polymer, thermosetting plastic or rubber. The cord has one or more elongated shank components 94, 94' and one or more outwardly expandable components 96, 96' which are axially spaced apart. The illustrated embodiment shows a uniform pitch distance between the components, and a variable pitch distance could be provided as required by a particular application.

The cord 92 can be formed by an extrusion process in which the material is injected through a suitable die or nozzle (not shown) which forms an extrudate having a cross-sectional shape conforming to that of the die. The die cross-section can be round, oval or other geometric shape, as desired. The extrudate is directed into a bath (not shown) which cools it sufficient to begin curing of the material. Prior to entering the bath, controlled amounts of air or other gas are injected inside the extrudate at the positions where the expandable components are to be formed. A nozzle (not shown) for injecting the air can extend concentrically through the extrusion die, with intermittent pulses of pressurized air being injected so that the molten extrudate bulges out at spaced-apart positions to enlarged diameters, thereby forming the spaced-apart expandable components shown in FIG. 7. The expandable components could also be formed by drawing a vacuum by suitable means about the extrudate upstream of the cooling bath.

After the extrudate cures, the cord can be stretched by tensioning it so that the expandable components shrink to a diameter which is sufficiently small to enable the cord to pass through the desired opening, such as an eyelet of a shoe. Then when the tension is released elastic memory of the expandable component enables outward expansion back to the enlarged diameter which is sufficient to resist movement through the opening.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A cordage for threading through an opening, the cordage comprising: an elastic solid core and a flexible sheath having an elongated shank component and at least one outwardly expandable component, the shank component having a first diameter which is sized sufficient to enable its movement through the opening, the expandable component when the core is under a given axial tension having a second diameter which is sufficiently small to enable its movement through the opening, and the expandable component having an elastic memory which is sufficient to enable its outward expansion, responsive to the axial tension below said given tension, to a third diameter which is sufficiently larger than the opening to resist movement of the cordage through the opening.

2. A cordage as in claim 1 in which the core is comprised of an integral length of elastic material.

3. A cordage as in claim 1 in which the sheath comprises at least one segment having a mid portion which defines said expandable component and a pair of end portions which straddle the mid portion, the end portions being in anchored relationship with the core, the mid portion being detached from the core to enable said outward expansion together with simultaneous movement of the end portions toward each other.

4. A cordage as in claim 3 in which the sheath is comprised of a braided material having a first braid pattern at the end portions which is sufficiently tight to frictionally grip with the core and thereby enable said anchored relationship between the end portions and core.

5. A cordage as in claim 4 in which the braided material has a second braid pattern at the mid-portion which is sufficiently loose to enable said detached relationship between the mid-portion and core.

6. A cordage as in claim 3 in which the sheath is comprised of a braided material having a first braid pattern at the end portions which is sufficiently tight to frictionally grip with the core and thereby enable said anchored relationship between the end portions and core, and the braided material has a second braid pattern at the mid-portion which is sufficiently loose to enable said detached relationship between the mid-portion and core.

7. A cordage as in claim 6 and comprising a bond between each end portion and the core for enabling said anchored relationship.

8. A cordage as in claim 7 in which the bond is selected from the group consisting of an adhesive, a sonic bond, heat fusion, stitching, a staple, a rivet and a band wrapped around the sheath sufficiently tight to cause frictional engagement between the sheath and core.

9. A cordage as in claim 3 in which the end portions of the sheath are stitched to the core to enable said anchored relationship between the end portions and core.

10. A cordage as in claim 3 in which the sheath comprises an elastomeric tube having a concentric bore which fits about the core.

* * * * *